US011913296B1

(12) United States Patent
Winarno

(10) Patent No.: US 11,913,296 B1
(45) Date of Patent: Feb. 27, 2024

(54) AUTO RECYCLE SYSTEM TO MAINTAIN FLUID LEVEL ON ESP OPERATION

(71) Applicant: SAUDI ARABIAN OIL COMPANY, Dhahran (SA)

(72) Inventor: Mulad Budi Winarno, Udhailiyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/045,350

(22) Filed: Oct. 10, 2022

(51) Int. Cl.
*E21B 43/12* (2006.01)
*E21B 21/08* (2006.01)

(52) U.S. Cl.
CPC ..... *E21B 21/08* (2013.01); *E21B 43/128* (2013.01)

(58) Field of Classification Search
CPC .... E21B 43/128; E21B 43/121; E21B 43/122; E21B 43/123; E21B 43/1235; E21B 43/124; E21B 43/126; E21B 43/127; E21B 43/129; E21B 43/13
See application file for complete search history.

(56) References Cited

U.S. PATENT DOCUMENTS

2003/0145991 A1* 8/2003 Olsen ..... E21B 43/13 166/265
2018/0051544 A1* 2/2018 Franco ..... E21B 43/123
2018/0163526 A1* 6/2018 Chidi ..... E21B 43/128
2021/0115782 A1* 4/2021 Mujica ..... F04B 49/08

* cited by examiner

*Primary Examiner* — David Carroll
(74) *Attorney, Agent, or Firm* — Osha Bergman Watanabe & Burton LLP

(57) ABSTRACT

A well production system may include a production tubing string, a submersible pump, a Christmas tree, a pressure control flowline, one or more control valves, and a control system. The production tubing string may include a production bore and an annulus and be disposed within a wellbore. The submersible pump may be disposed within the wellbore and include an inlet and an outlet. The Christmas tree may have an inlet configured to receive produced fluids from the submersible pump and an outlet in fluid communication with a production flowline. The pressure control flowline may fluidly connect the production flowline with the annulus. The one or more control valves may be configured to control a flow of produced fluids in the production flowline and the pressure control flowline. The control system may be configured to control a position of the one or more control valves.

16 Claims, 3 Drawing Sheets

AUTO RECYCLE SYSTEM TO MAINTAIN FLUID LEVEL ON ESP OPERATION

FIELD OF THE DISCLOSURE

Embodiments of the present disclosure generally relate to production of fluid from subterranean reservoirs. More particularly, the disclosure relates to an auto recycle system to maintain fluid level during the use of an Electrical Submersible Pump (ESP) for fluid production, and systems and methods for operating the system.

BACKGROUND

Fluids are typically produced from a reservoir in a subterranean formation by drilling a wellbore into the subterranean formation, establishing a flow path between the reservoir and the wellbore, and conveying the fluids from the reservoir through the wellbore to a destination such as to the surface of the earth, to a bed of a body of water such as a lakebed or a seabed, or to a surface of a body of water such as a swamp, a lake, or an ocean (hereafter "surface.") Fluids produced from a hydrocarbon reservoir may include natural gas, oil, and water. Typically, a production tubing is disposed in the wellbore to carry the fluids to the surface. In some formations, pressure within the rock formation causes the resources to flow naturally from the formation to the surface. One common challenge in producing fluids from a hydrocarbon reservoir through a wellbore is that, in some formations, the pressure in the formation is not adequate to cause the flow against gravity out of the formation to the surface; or is not adequate to cause the flow to meet flowrate goals. In such instances, artificial lift technology can be utilized to add energy to fluid to bring the resources to the surface.

For bringing liquids out of a subterranean wellbore to the surface of the Earth, various techniques such as artificial lift technology may be used. Artificial lift technology may include, for example, a pump and associated components to assist in lifting the fluids up the wellbore. As an example, production tubing associated with the wellbore may include one or more pumps to assist in lifting the fluids up the wellbore. The pump may be electrically operated and located submerged in the fluid at or near the bottom of the well. The pump system may use a surface or seabed power source to drive the submerged pump assembly. Alternatively, power for the pump may be provided at another location downhole in the well, such as a downhole fuel cell. These pump systems so configured are termed electric submersible pump (ESP) systems.

In hydrocarbon well development, it is common practice to use electrical submersible pumping systems (ESPs) as a primary form of artificial lift. A challenge with ESP operations is maintaining fluid level, and it is common to cycle ESPs from operating (on) to not operating (off) based on intake pressure. Cycling of an ESP due to low intake pressure can shorten the lifespan of the ESP. Further, well performance issues may arise, and if incorrectly attributed to a healthy ESP, may result in unnecessary workover operations.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Embodiments disclosed herein relate to a well production system. The system includes a production tubing string, a submersible pump, a Christmas tree, a pressure control flowline, one or more control valves, and a control system. The production tubing string and the submersible pump may be disposed within a wellbore. The production tubing string may have an internal passageway defining a production bore and an outer surface defining an annulus between the production tubing string and the wellbore. The submersible pump may include an inlet for receiving produced fluids from the wellbore and an outlet in fluid communication with the production bore. The Christmas tree may have an inlet in fluid communication with the production bore, and an outlet in fluid communication with a production flowline. The inlet may be configured to receive produced fluids from the submersible pump. The pressure control flowline may fluidly connect the production flowline with the annulus. The one or more control valves may be configured to control a flow of produced fluids in the production flowline and the pressure control flowline. The control system may be configured to control a position of the one or more control valves based on an intake pressure of the submersible pump.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

Figure 1:
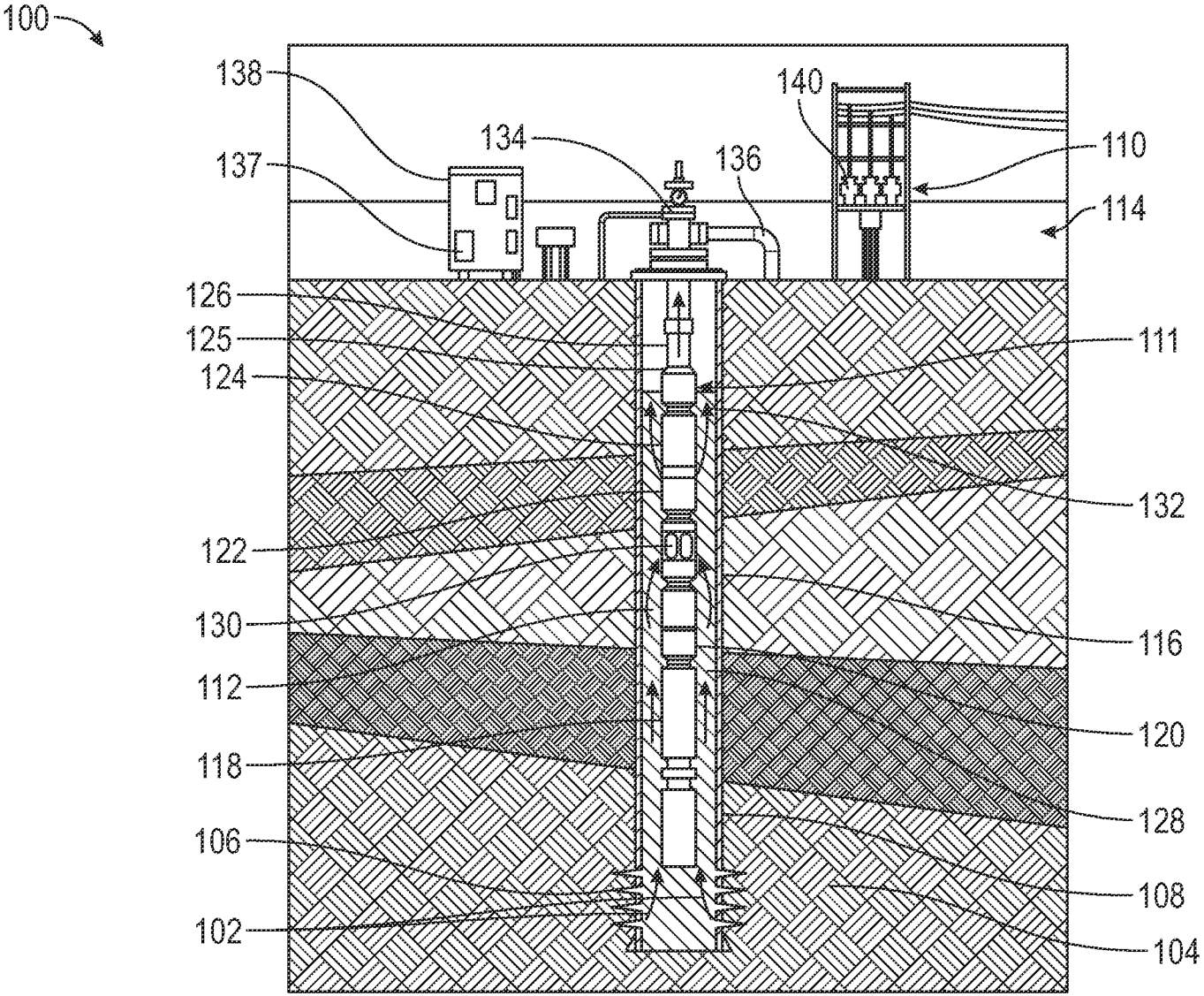
FIG. 1 shows an exemplary well with an Electrical Submersible Pump (ESP) completion design in accordance with one or more embodiments.

Regarding the figures described herein, when using the term "down" the direction is toward or at the bottom of a respective figure and "up" is toward or at the top of the respective figure. "Up" and "down" are oriented relative to a local vertical direction. However, in the oil and gas industry, one or more activities take place in a vertical, substantially vertical, deviated, substantially horizontal, or horizontal well. Therefore, one or more figures may represent an activity in deviated or horizontal wellbore configuration. "Up" or "uphole" may refer to objects, units, or processes that are positioned relatively closer to the surface entry in a wellbore than another. "Down" or "downhole" may refer to objects, units, or processes that are positioned relatively farther from the surface entry in a wellbore than another. True vertical depth is the vertical distance from a point in the well at a location of interest to a reference point on the surface.

DETAILED DESCRIPTION

Embodiments disclosed herein relate to systems and methods that may be used to operate downhole submersible pumps, such as ESPs, continuously, without the need to cycle the submersible pumps between operational (on) and not operational (off) due to low intake pressure. Embodiments herein provide an automated pressure control system that is configured to return production fluid as needed to the annular space based on a measured pump intake pressure or a pressure in the wellbore proximate the submersible pump (proximate or near, as used herein, refers to being positioned close to one another, such as being adjacent, adjoining, or close in proximity, such as within a few feet, such that the pressure measured is representative of the pump intake pressure). The return of production fluid to the well may maintain a fluid level so as to provide sufficient submersible pump intake pressure; in other words, an intake pressure measured at or near the submersible pump may be used to maintain a fluid column height above the submersible pump so as to provide a minimum intake pressure, regardless of the amount of fluids being produced by the reservoir. Maintaining the submersible pumps intake pressure, in turn, may allow a submersible pump to run continuously, prolonging the run life of the submersible pump, avoiding frequent cycling of the pump, and avoiding workover cost to replace a fully functioning submersible pump due to well performance issues and to reduce submersible pump related production losses due to well performance issues.

Embodiments herein thus relate to well production systems and methods to maintain a submersible pump intake pressure during well production. The system may include a production tubing string disposed within a wellbore, extending from a top of the wellbore to a downhole location. For example, the production tubing string may be hung from a tubing hanger disposed in a wellhead or a Christmas tree disposed atop a wellhead and may extend into the well hundreds or thousands of meters to an underground reservoir. The production tubing may include an internal passageway or flow bore, otherwise referred to herein as a production bore. An outer surface of the production tubing may define an annulus or annular region between the production tubing string and the wellbore.

One or more submersible pumps, such as ESPs, may be provided along the production tubing string. For example, a submersible pump, such as an ESP, may be disposed at one or more locations or heights along the production tubing string. As another example, a submersible pump may be disposed at or proximate a lower terminal end of the production tubing string.

The submersible pump(s) may include an inlet for receiving reservoir fluids, fluids from the reservoir migrating to the wellbore (i.e., produced fluids) that are then provided energy by the pump, fed through the outlet of the submersible pump into the production bore, and thence to the surface. The submersible pump(s) thus include an inlet for receiving fluids from the wellbore and an outlet in fluid communication with the production bore of the production tubing string.

At the surface, an assembly commonly referred to as a Christmas tree may be provided at the wellhead. The Christmas tree is an assembly of valves, piping spools and other equipment fitted to a wellhead of a completed well to control production, and may include various valves, such as a kill wing valve, swab valves, and production wing valves, as well as an upper and lower master valve, among others, and the associated piping spools may be provided to provide for production, such as through the production wing valve, or other well operations. The Christmas tree includes an inlet in fluid communication with the production bore of the production tubing string. The Christmas tree also includes an outlet in communication with a production flowline, for transporting produced fluids downstream to production unit operations or production facilities.

To maintain intake pressure of the one or more submersible pumps, embodiments herein provide a pressure control flowline fluidly connecting the production flowline with the wellbore annulus. A control system and one or more control valves may also be provided to control a flow of produced fluids in the production flowline and in the pressure control flowline based on an intake pressure of the submersible pump. A sensor or sensors may be provided to measure the intake pressure of the submersible pump, such as a pres sure sensor disposed on the inlet of the submersible pump, or a pressure sensor disposed within the wellbore proximate the submersible pump.

Operation of the control valves may provide for transport of the produced fluids to the downstream production unit operations or production facilities. Operation of the control valves may also provide for a return of the produced fluids, or a portion thereof, to the wellbore annulus so as to maintain the intake pressure of the submersible pump at or above a minimum intake pressure. By using produced fluids, as needed, to maintain a fluid column above the submersible pump, the intake pressure of the submersible pump will be continuously above a minimum intake pressure, and thus the submersible pump may be operated continuously, negating the need to cycle the pump operations on/off because of insufficient intake pressure.

In some embodiments, the one or more control valves may include a first control valve disposed on the production flowline for controlling a flow of the produced fluids from the Christmas tree to a downstream location. The one or more control valves may also include a second control valve disposed on the pressure control flowline for diverting at least a portion of the flow of the produced fluids from the production flowline to the annulus. The first control valve may be, for example, a choke valve; other types of valves may also be used. The second control valve may be, for example, a choke valve, a ball valve, a gate valve, or any other suitable type of valves. In some embodiments, the first control valve may be disposed on the production flowline intermediate the Christmas tree and the pressure control flowline; additional valves may also be positioned on the production flowline upstream or downstream of the first control valve, such as may be used to isolate the system or perform other wellbore operations. The position of the second control valve may thus be used to control a flow (on/off valve) or a flow rate (variable opening valve) of produced fluids diverted from the production flowline through the pressure control line to the annulus.

In other embodiments, the one or more control valves may include a three-way valve. The three-way valve may, for example, include an inlet for receiving a flow of produced fluids, a first outlet for providing a flow of the produced fluids to a downstream location, and a second outlet for providing a flow of the produced fluids to the annulus. The position of the three-way valve may thus be used to control a flow of produced fluids diverted from the production flowline through the pressure control line to the annulus.

As described above, systems according to embodiments herein may be used to maintain or control an intake pressure of a submersible pump disposed within a well. The intake pressure of the submersible pump may be measured, such as by one or more sensors that communicate with a control system to provide the measured intake pressure. Based on the measured intake pressure, the control system may then control a flow of the produced fluids, from the production flowline to the annulus, using the above-described one or more control valves.

While operating automatically to control intake pressure, in some embodiments the control system, such as an FSD/VSD, may display one or more of the intake pressures, a set point pressure, a pressure differential, or a position of the one or more control valves (open, closed, percent open, etc.), as well as other aspects of the system, for visual review by an operator. The set point pressure may be input into the control system by an operator in some embodiments. The set point pressure for the intake pressure may be based on various factors, including the pump size, the diameter of the production bore, the distance or height that the submersible pump needs to pump the produced fluids, and the type and composition of the fluid or fluid mixture (water, oil, gas, etc.) within the wellbore to be produced, among others.

In some embodiments, the set point pressure may be based upon a bubble point of the fluid mixture being produced from the wellbore. For example, the produced fluids may include water, oil, and dissolved gases, such as one or more of nitrogen, carbon dioxide, and methane, ethane, or other light hydrocarbons, among others. In one or more embodiments, the set point pressure may be below the fracture pressure of the formation. The bubble point may depend on a variety of parameters including the composition of the fluid mixture (such as hydrocarbon type and content, gas type and content, water content, etc.), properties of the formation (rock type, temperature, etc.), and other various factors as would be recognized by one skilled in the art. The bubble point of the fluid mixture being produced from the wellbore may be measured or may be calculated based on the measured or estimated composition of the produced liquids and gases. To keep the fluids at the intake of the submersible pump as a single-phase fluid, the set point for the intake pressure of the submersible pump may be a pressure that is greater than the bubble point pressure. For example, in some embodiments the set point pressure may be 20 pounds per square inch (psi) to 300 psi above the bubble point pressure, such as 125 psi to 225 psi above the bubble point pressure or from 150 psi to 200 psi above the bubble point pressure.

A control system may also include a trip pressure set point, which may be a lower pressure limit at which the control system will "trip" the submersible pump, turning the pump off to avoid cavitation or otherwise compromise pump operations and/or well integrity. The trip pressure set point may also be set at a given pressure above the bubble point pressure, such as from 10 psi to 250 psi above the bubble point pressure, such as from 100 psi to 200 psi above the bubble point pressure or from 125 to 175 psi above the bubble point pressure.

When including a trip pressure set point and a set point pressure for the intake pressure of a submersible pump in systems according to embodiments herein, the intake pressure set point for normal system operations may be 25 to 75 psi above the trip pressure set point, such as 50 psi above the trip pressure set point.

As a non-limiting example, the produced fluid may have a bubble point pressure of 300 pounds per square inch gauge (psig). The trip set point pressure may be 400 psig, and the set point pressure for the intake pressure of the submersible pump may be 450 psig. A sensor may measure a pressure of the produced fluids in the wellbore proximate the intake of the submersible pump, sending a signal representative of the measured pressure to the control system. The control system, in turn, may use the measure pressure to control a position of the control valves. When the pressure is less than the set point pressure, the valves may be positioned to divert a totality or a portion of the produced fluids from the production flowline, through the pressure control flowline, back into the annulus, thus increasing the fluid column above the submersible pump and increasing an intake pressure of the submersible pump. When the pressure increases above the set point pressure, the control system may position the valves to shut off or decrease the flow of the produced fluids through the pressure control flowline, thus pumping produced fluids to downstream production equipment, decreasing the fluid column above the submersible pump and decreasing an intake pressure of the submersible pump. Due to the differences between the set point pressure and the trip set point pressure, the controller may manipulate the valves automatically based on the pressure intake of the submersible pump and maintain the fluid level in the wellbore, avoiding tripping of the submersible pump due to low intake pressure (low fluid level). In the event of unusual wellbore operations, where a disturbance may result in a significant decrease in pressure, the trip set point pressure may be reached, shutting off the submersible pump; however, due to the control system configuration, pump damage may be avoided and the pump safely restarted when wellbore conditions for normal operations are restored.

FIG. 1 depicts an illustrative exemplary production system 100 according to embodiments herein. The production system 100 is one example of an artificial lift system that is used to help produced fluids 102 from a formation 104, and FIG. 1 illustrates the major pieces of equipment that may be used in the artificial lift system. Perforations 106 in the well's 116 casing string 108 provide a conduit for the produced fluids 102 to enter the well 116 from the formation 104. The production system 100 also includes surface equipment 110 and a production tubing string 111. The production tubing string 111 is deployed in a well 116 and the surface equipment 110 is located on the surface 114. The surface 114 is any location outside of the well 116, such as the Earth's surface, which may be located subsea or on land.

Located along the production tubing string, such as at a terminal end of the production tubing string 111 may be located an electric submersible pump string 112 (ESP string 112). The ESP string 112 may include a motor 118, motor protectors 120, a gas separator 122, a multi-stage centrifugal pump 124, and an electrical cable 126. The ESP string 112 may also include various pipe segments of different lengths to connect the components of the ESP string 112. The motor 118 is a downhole submersible motor 118 that provides power to the multi-stage centrifugal pump 124. The motor 118 may be a two-pole, three-phase, squirrel-cage induction electric motor, for example. The operating voltages, currents, and horsepower ratings of motor 118 may depend on the requirements of the operation. While not illustrated to scale, the ESP string 112 may be disposed such that the pump intake 130 is submerged and a fluid column is located within annulus 128 above the pump intake 130.

The size of the motor 118 is dictated by the amount of power that the multi-stage centrifugal pump 124 requires to lift an estimated volume of produced fluids 102 from the bottom of the well 116 to the surface 114. The motor 118 is cooled by the produced fluids 102 passing over the motor housing. The motor 118 may be powered by the electrical cable 126. The electrical cable 126 may also provide power to downhole pressure sensors or onboard electronics that may be used for communication. The electrical cable 126 may be clamped to the ESP string 112 in order to limit electrical cable 126 movement in the well 116. In further embodiments, the ESP string 112 may have a hydraulic line that is a conduit for hydraulic fluid. The hydraulic line may act as a sensor to measure downhole parameters such as discharge pressure from the outlet of the multi-stage centrifugal pump 124.

Motor protectors 120 are located above (i.e., closer to the surface 114 than) the motor 118 in the ESP string 112. The motor protectors 120 are a seal section that houses a thrust bearing. The thrust bearing accommodates axial thrust from the multi-stage centrifugal pump 124 such that the motor 118 is protected from axial thrust. The seals isolate the motor 118 from produced fluids 102. The seals further equalize the pressure in the annulus 128 with the pressure in the motor 118. The annulus 128 is the space in the well 116 between the casing string 108 and the ESP string 112. The pump intake 130 is the section of the ESP string 112 where the produced fluids 102 enter the ESP string 112 from the annulus 128.

The pump intake 130 (pump inlet) is located above the motor protectors 120 and below the multi-stage centrifugal pump 124. The depth of the pump intake 130 is designed based off of the formation 104 pressure, estimated height of produced fluids 102 in the annulus 128, and optimization of the multi-stage centrifugal pump 124 performance. If the produced fluids 102 have associated gas, then a gas separator 122 may be installed in the ESP string 112 above the pump intake 130 but below the multi-stage centrifugal pump 124. The gas separator 122 removes the gas from the produced fluids 102 and injects the gas (depicted as separated gas 132 in FIG. 1) into the annulus 128. If the volume of gas exceeds a designated limit, a gas handling device may be installed below the gas separator 122 and above the pump intake 130.

The multi-stage centrifugal pump 124 is located above the gas separator 122 and lifts the produced fluids 102 to the surface 114. The submersible pump multi-stage centrifugal pump 124 may include a plurality of stages that are stacked upon one another. Each stage contains a rotating impeller and stationary diffuser. As the produced fluids 102 enter each stage, the produced fluids 102 pass through the rotating impeller to be centrifuged radially outward gaining energy in the form of velocity. The produced fluids 102 enter the diffuser, and the velocity is converted into pressure. As the produced fluids 102 pass through each stage, the pressure continually increases until the produced fluids 102 obtain the designated discharge pressure and has sufficient energy to flow to the surface 114. The fluids may thus be drawn into the submersible pump through pump intake 130, be pressurized within the multi-stage centrifugal pump 124, discharged through an outlet 125 of the submersible pump into the production tubing string 111 and flow through the production bore to the wellhead 134 and thence downstream to production equipment 136.

In other embodiments, sensors may be installed in various locations along the ESP string 112 to gather downhole data such as pump intake volumes, discharge pressures, shaft speeds and positions, and temperatures. The number of stages is determined prior to installation based of the estimated required discharge pressure. Over time, the formation 104 pressure may decrease and the height of the produced fluids 102 in the annulus 128 may decrease. In these cases, the ESP string 112 may be removed and resized. Once the produced fluids 102 reach the surface 114, the produced fluids 102 flow through the wellhead 134 into production equipment 136. The production equipment 136 may be any equipment that can gather or transport the produced fluids 102, such as a pipeline or a tank.

The remainder of the production system 100 includes a wide variety of surface equipment 110 such as electric drives 137, production controller 138, the control module, and an electric power supply 140. The electric power supply 140 provides energy to the motor 118 through the electrical cable 126. The electric power supply 140 may be a commercial power distribution system or a portable power source such as a generator. The production controller 138 is made up of an assortment of intelligent unit-programmable controllers and drives which maintain the proper flow of electricity to the motor 118 such as fixed-frequency switchboards, soft-start controllers, and variable speed controllers. The production controller 138 may be a variable speed drive (VSD), well choke, inflow control valve, and/or sliding sleeves. The production controller 138 is configured to perform automatic well operation adjustments. The electric drives 137 may be variable speed drives that read the downhole data, recorded by the sensors, and may scale back or ramp up the motor 118 speed to optimize the multi-stage centrifugal pump 124 efficiency and production rate. The electric drives 137 allow the multi-stage centrifugal pump 124 to operate continuously and intermittently or be shut off in the event of an operational problem.

Figure 2:
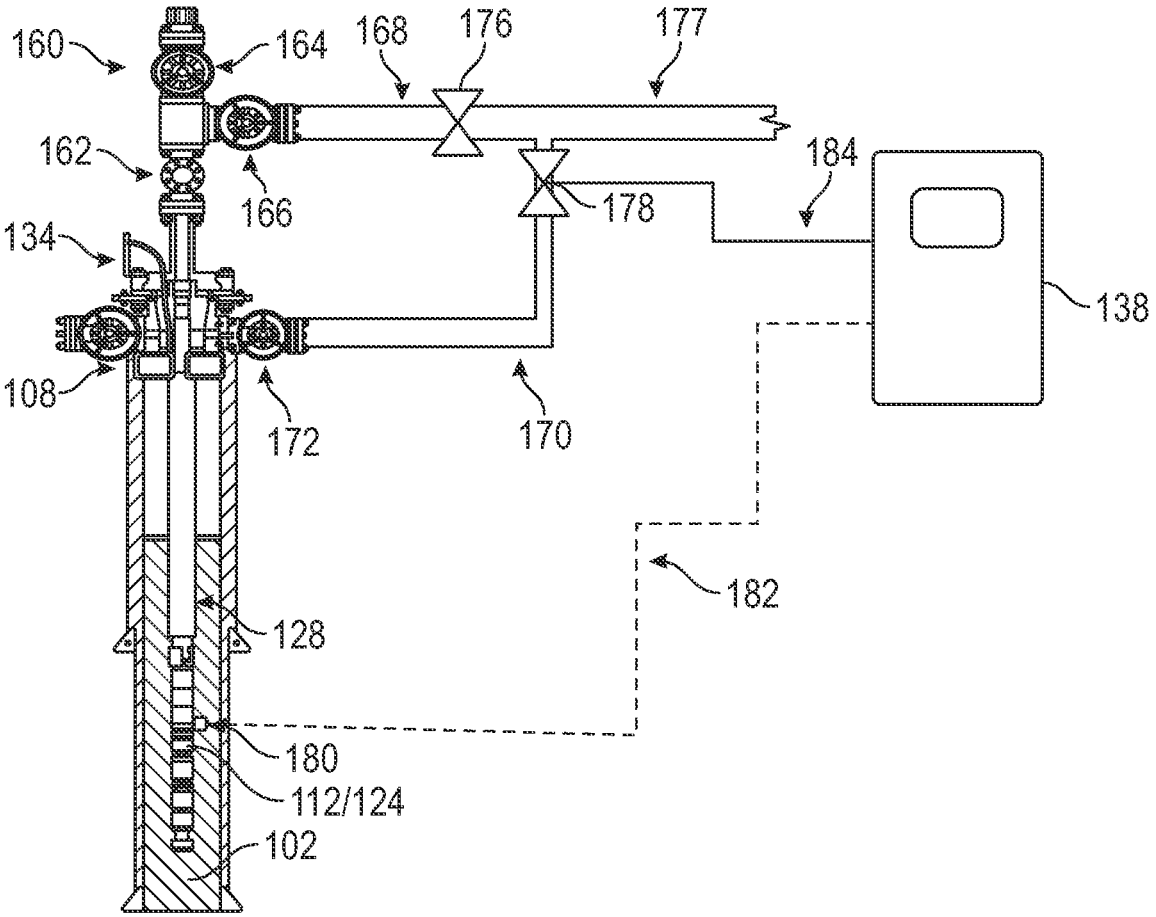
FIG. 2 shows an exemplary overall system for maintaining fluid level in a well in accordance with one or more embodiments.

FIG. 2 shows a system for maintain fluid level in a wellbore in accordance with one or more embodiments, where like numerals represent like parts. As described above with respect to FIG. 1, the multi-stage centrifugal pump 124 may receive produced fluids 102 at intake 130 and be lifted to wellhead 134 and into an inlet of a Christmas tree 160 that may be located atop wellhead 134. Christmas tree 160 may include a master control valve 162, a swab valve 164, and a production wing valve 166, among other components. Connected to the production wing valve 166 may be a production flowline 168 for transporting produced fluids to a downstream location, such as production equipment 136 (FIG. 1).

A pressure control flowline 170 may be provided, fluidly connecting production flowline 168 to annulus 128. As illustrated in FIG. 2, the production flowline 168 may connect to annulus 128, such as through a valve 172 associated with wellhead 134. Wellheads and flow conduits through wellheads vary, and thus various configurations are possible. In other embodiments, production flowline 168 may have a direct fluid connection to casing string 108 or may be fluidly connected at other appropriate locations to provide fluid flow from the pressure control flowline 170 back into the annulus 128. Some production fluid may return to the annulus 128 through a modified or fabricated flowline 170 from the production flowline 168 to the connection of the valve 172. The modified flowline size may be smaller compared to the production flowline 168. The modified flowline size may be determined based on the expected flow rate of the fluid to be flown back to annulus 128. Returned fluids that to the annulus 128 may have the same properties as the production fluid.

To control the flow of produced fluids, one or more control valves may be provided to control the flow of produced fluids in the production flowline 168 and in the pressure control flowline 170. As illustrated in FIG. 2, a first control valve 176 may be disposed along the production flowline 168, such as intermediate the Christmas tree 160 and the pressure control flowline, to control a flow of fluids from the Christmas tree to a downstream location, such as via flow line 177, to production equipment 136 of the downstream (FIG. 1). A second control valve 178 may be disposed on the pressure control flowline 170, for controlling a flow of produced fluids from the production flowline 168 through pressure control flowline 170 back into the annulus 128.

A pressure sensor 180 may be disposed proximate pump intake 130 for measuring a pressure of the produced fluids 102 proximate the intake. The pressure sensor 180 may transmit a signal via signal line 182 to controller 138. Based on the measured pressure and a set point pressure, controller 138 may then send a signal via signal line 184 to the second control valve 178 to regulate a position of the control valve, opening the valve 178 to increase a pressure within annulus 128 when the measured pressure is less than a set point pressure, or closing the second control valve 178 to decrease a pressure within annulus 128 when the measured pressure is greater than a set point pressure.

Figure 3:
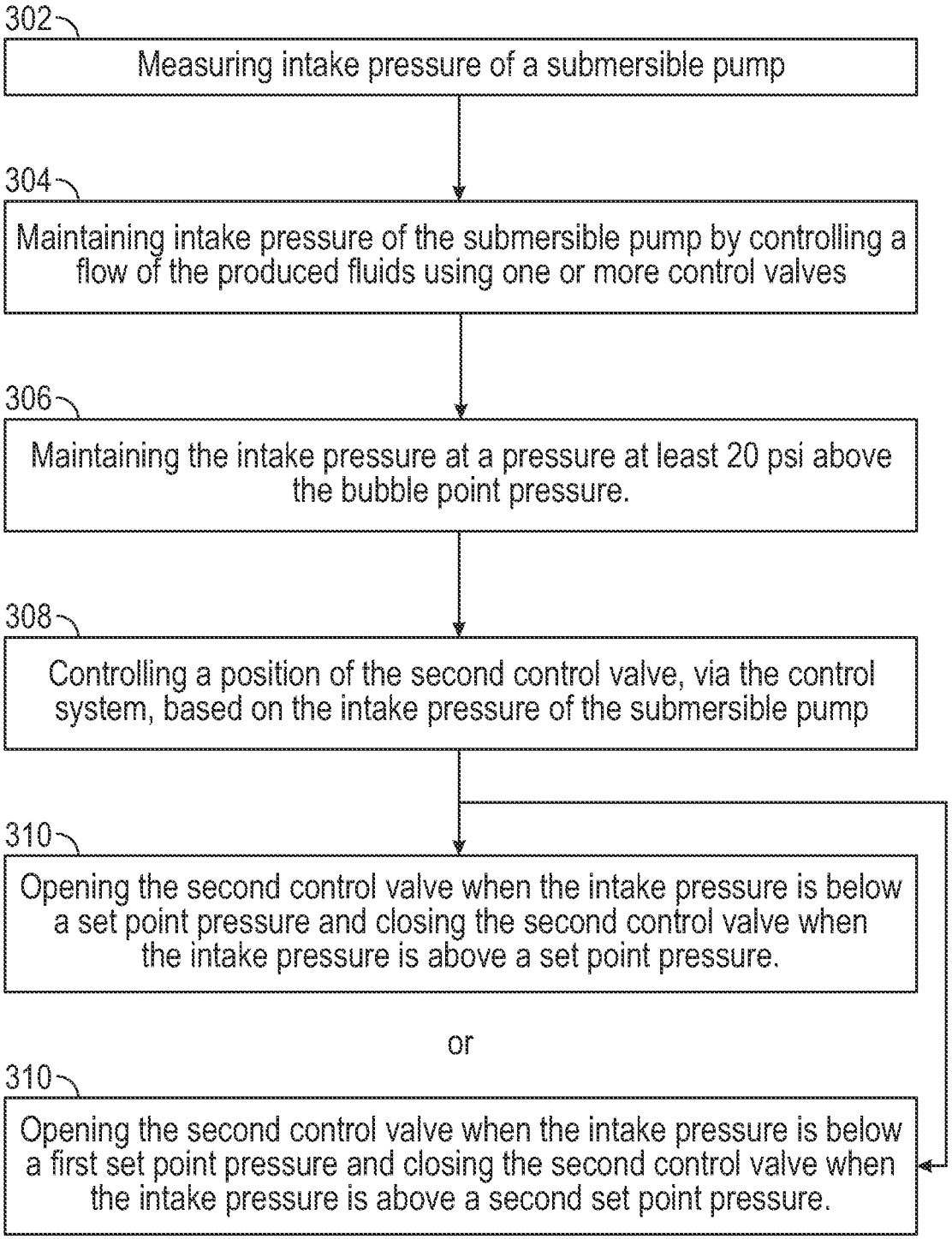
FIG. 3 illustrates exemplary method steps for maintaining fluid level in a well in accordance with one or more embodiments.

FIG. 3 illustrates exemplary method steps for maintaining fluid level in a well in accordance with one or more embodiments, where like numerals represent like parts. The method may comprise several steps including step 302, which is measuring an intake pressure of a submersible pump. In step 304, the method may include maintaining intake pressure of the submersible pump by controlling a flow of the produced fluids using one or more control valves. A first control valve may be disposed on the production flowline for controlling a flow of the produced fluids from the Christmas tree to a downstream location, as disclosed above. A second control valve may be disposed on the pressure control flowline for diverting at least a portion of the flow of the produced fluids from the production flowline to the annulus, as disclosed above.

In step 306, the method may include maintaining the intake pressure at a pressure at least 20 psi above the bubble point pressure. The bubble point pressure of the produced fluids may be a measured or estimated bubble point pressure. Furthermore, in step 308, the method may include controlling a position of the second control valve, via the control system, based on the intake pressure of the submersible pump. In some embodiments, the step 310 of the method may include opening the second control valve when the intake pressure is below a set point pressure and closing the second control valve when the intake pressure is above a set point pressure. In other embodiments, the step 310 of the method may include opening the second control valve when the intake pressure is below a first set point pressure and closing the second control valve when the intake pressure is above a second set point pressure. The second set point pressure may be greater than the first set point pressure.

As described above, embodiments of the present disclosure may provide at least one of the following advantages. The disclosed system includes an automated pressure control system that allows the system to return production fluid into the annular of the well without any manual labor. The disclosed system may enable maintenance of the fluid level while keeping the submersible pump running in operation. Unlike conventional systems, the disclosed system does not require the ESP to stop for maintaining the fluid level in the well. Furthermore, the disclosed system may be applicable for wells with no ESP packer completion, oil wells with low gas to oil ratios, and oil wells with no hydrogen sulfide or water wells. The disclosed system may be installed as remedial work due to declining well performance or in the initial completion to anticipate uncertain well performance, such as low pressure in the future operations, avoiding workover operation to replace the ESP.

While one or more embodiments of the present disclosure have been described with respect to a limited number of embodiments, those skilled in the art, having benefit of this disclosure, will appreciate that other embodiments can be devised, which do not depart from the scope of the disclosure. Accordingly, the scope of the disclosure should be limited only by the attached claims.

What is claimed:

1. A well production system, the system comprising:

a production tubing string disposed within a wellbore, the production tubing string having:

an internal passageway defining a production bore; and an outer surface defining an annulus between the production tubing string and the wellbore;

a submersible pump disposed within the wellbore, the submersible pump comprising an inlet for receiving produced fluids from the wellbore and an outlet in fluid communication with the production bore;

a Christmas tree having an inlet in fluid communication with the production bore, configured to receive produced fluids from the submersible pump, and an outlet in fluid communication with a production flowline;

a pressure control flowline fluidly connecting the production flowline with the annulus;

one or more control valves configured to control a flow of produced fluids in the production flowline and the pressure control flowline; and a control system configured to control a position of the one or more control valves based on an intake pressure of the submersible pump.

2. The system of claim 1, further comprising a sensor disposed on the inlet of the submersible pump, the sensor configured to measure the intake pressure.

3. The system of claim 1, further comprising a sensor disposed within the wellbore proximate the submersible pump, the sensor configured to measure the intake pressure.

4. The system of claim 1, wherein the one or more control valves comprises:

a first control valve disposed on the production flowline for controlling a flow of the produced fluids from the Christmas tree to a downstream location; and a second control valve disposed on the pressure control flowline for diverting at least a portion of the flow of the produced fluids from the production flowline to the annulus.

5. The system of claim 4, wherein the first control valve is a choke valve.

6. The system of claim 5, wherein the choke valve is disposed on the production flowline intermediate the Christmas tree and the pressure control flowline.

7. The system of claim 1, wherein the one or more control valves comprises a three-way valve including an inlet for receiving a flow of produced fluids, a first outlet for providing a flow of the produced fluids to a downstream location, and a second outlet for providing a flow of the produced fluids to the annulus.

8. A method for maintaining a wellbore during production using the well production system of claim 1, the method comprising:

measuring the intake pressure of the submersible pump; and maintaining the intake pressure of the submersible pump by controlling a flow of the produced fluids from the production flowline through the pressure control flowline into the annulus using the one or more control valves.

9. The method of claim 8, further comprising:

measuring a bubble point pressure of the produced fluids; and maintaining the intake pressure at a pressure at least 20 psi above the bubble point pressure.

10. The method of claim 9, further comprising maintaining the intake pressure at a pressure 20 psi to 300 psi above the bubble point pressure.

11. The method of claim 8, wherein the one or more control valves comprises:

a first control valve disposed on the production flowline for controlling a flow of the produced fluids from the Christmas tree to a downstream location; and a second control valve disposed on the pressure control flowline for diverting at least a portion of the flow of the produced fluids from the production flowline to the annulus.

12. The method of claim 11, further comprising controlling a position of the second control valve, via the control system, based on the intake pressure of the submersible pump.

13. The method of claim 12, wherein controlling a position of the second control valve comprises opening the second control valve when the intake pressure is below a set point pressure and closing the second control valve when the intake pressure is above a set point pressure.

14. The method of claim 12, wherein controlling a position of the second control valve comprises opening the second control valve when the intake pressure is below a first set point pressure and closing the second control valve when the intake pressure is above a second set point pressure, wherein the second set point pressure is greater than the first set point pressure.

15. The method of claim 8, wherein the one or more control valves comprises:

a three-way valve including an inlet for receiving a flow of produced fluids;

a first outlet for providing a flow of the produced fluids to a downstream location; and a second outlet for providing a flow of the produced fluids to the annulus.

16. The method of claim 15, further comprising controlling a position of the three-way valve, via the control system, based on the intake pressure of the submersible pump.

* * * * *